United States Patent [19]

Chambers

[11] Patent Number: 4,953,783

[45] Date of Patent: Sep. 4, 1990

[54] MAILBOX SIGNAL DEVICE

[76] Inventor: John D. Chambers, Rt. 2 Box 363C, Azle, Tex. 76020

[21] Appl. No.: 286,694

[22] Filed: Dec. 20, 1988

[51] Int. Cl.[5] ..... D65D 91/00; A47G 29/12

[52] U.S. Cl. ..... 232/35; 232/34

[58] Field of Search ..... 232/35, 34, 17

[56] References Cited

U.S. PATENT DOCUMENTS

| | | | |
|---|---|---|---|
| 2,581,880 | 1/1952 | Price | 232/35 |
| 3,143,287 | 8/1964 | Holt | 232/35 |
| 3,547,070 | 12/1970 | Schuh | 116/114 |
| 3,602,424 | 8/1971 | Raulston | 232/35 |
| 3,648,924 | 3/1972 | Burns | 232/35 |
| 3,650,464 | 3/1972 | Lewis | 232/35 |
| 3,747,839 | 7/1973 | Morton | 232/35 |
| 3,815,811 | 6/1974 | Harmon | 232/35 |
| 4,158,430 | 6/1979 | Wideman | 232/35 |
| 4,782,997 | 11/1988 | Cotton, Jr. | 232/35 |

*Primary Examiner*—Robert W. Gibson, Jr.

[57] ABSTRACT

A mailbox signal device for use in combination with rural type mailboxes which are configured with a door having a rearwardly extending flange; or, a door protected by a forwardly protruding hood. The signal device consists of a piece of strong wire or light rod with an eye formed on the rear end and a signal flag of flexible material attached near the front end. The device is loosely attached through the eye of the rod utilizing an existing mounting bolt on and near the rear end of the mailbox. the signal device is free to fall by gravity into a vertical position when triggered by opening the mailbox door. The signal device is made in two configurations. The first has a straight front end. When cocked, it rest on the tab formed on the flange of a backwardly flanged mail door. The second configuration signal device has a hook formed on the front end. When cocked, the hook rest on the bottom edge of a small hole drilled in a lower corner of a hooded type mailbox door.

3 Claims, 2 Drawing Sheets

MAILBOX SIGNAL DEVICE

BACKGROUND--FIELD OF INVENTION

This invention relates to a mailbox signal device, operated by gravity, which will indicate when mail has been delivered to a rural type mailbox.

BACKGROUND--DESCRIPTION OF PRIOR ART

Hundreds of mailbox signal devises have been patented over the years but many have been too complicated to be economically feasible. Others have required special parts to be manufactured. Still others, such as spring activated devices, are more subject to vandalism; and, may be inactivated by icing conditions. Over 120 patents were searched in an effort to establish the uniqueness of the presently applied for invention. A number of patents were studied in detail. U.S. Pat. No. 3,143,287 by M. O. Holt (1964) requires special parts be manufactured and requires accurate measurement and drilling of holes in the mailbox. U.S. Pat. No. 3,547,070 by Henry E. Schuh (1970) requires one simple part to be manufactured. Constant friction wear may make the device difficult to cock over a period of time. During icing conditions there is the possibility of freezing the mailbox closed and making mail delivery difficult. U.S. Pat. No. 3,602,424 by Thadleus Walter Raulston (1971) requires special parts be manufactured. Installation of the signal flag devise is close tolerance and icing conditions may render it inoperable. U.S. Pat. No. 3,648,924 by Homer Woodfin Burns (1972) requires relatively expensive parts be manufactured. This invention is susceptible to icing failure. The cam arrangement can be made inoperative by rusting unless made of more expensive rust resistant materials. U.S. Pat. No. 3,747,839 by Paul S. Morton (1973) is a refinement of U.S. Pat. No. 3,602,424 but is more expensive to manufacture. U.S. Pat. No. 4,158,430 by Ewell F. Wideman (1979) is complicated and expensive to manufacture. The trigger mechanism is inside the mailbox and the claim is made that the device is weatherproof. Since a rotating hub passes through a hole in the side of the mailbox there is the possibility that icing can render it inoperative. U.S. Pat. No. 2,581,880 by Lawson Price is unique but requires several manufacturing procedures and size restrictions that make it impractical unless installed by the mailbox manufacturers. U.S. Pat. No. 3,650,464 by John William Lewis is a single part that requires shearing, forming and drilling manufacturing procedures. The part, as shown, fits only one side of a mailbox. Mounting on the mailbox also requires fairly precise location. U.S. Pat. No. 3,815,811 by F. L. Harmon while simple in appearance does require a number of manufacturing procedures which makes it relatively expensive to make. It requires the location of and drilling a special hole in the mailbox for mounting. The device, as shown, fits only one side of the mailbox and is only applicable to a backwardly flanged mailbox. U.S. Pat. No. 4,782,997 by Thomas J. Cotton Jr. is an improvement of Harmon's device. The signal device is made of molded plastic requiring the fabrication of a die to form the part. High initial production will be required to make manufacturing economically feasible. The signal device will fit only one side of a backwardly flanged mailbox.

Although all the devices described above will serve their intended function it is believed that all suffer certain disadvantages when compared to the gravity operated flag indicator device of the present invention.

OBJECTIVES AND ADVANTAGES

I claim the following as my objectives and advantages for the invention offered herein; to provide a simple rod type signal device that is extremely economical and easy to manufacture; a flexible flag attached to the rod that offers the advantages of simple replacement, a variety of colors to provide individual mailbox identification in group installations; and, greater visibility because of larger flag size and wind action on the flag.

The invention will be offered in two configurations. Installation of the first configuration (straight front end on rod) applies to a rearwardly flanged mailbox door. It is extremely simple, requiring no holes be drilled, and requiring only one small downwardly slanted cut be made in the rearward flange of the mailbox door. Cocking this configuration is so simple that it can be done without looking. Installation of the second configuration (hook on front end of rod) applies to both hooded type and rearwardly flauged mailbox doors. It requires only one small hole in a lower corner of the mailbox door. This configuration is installed underneath the mailbox and is thus weatherproof. The second configuration device is required for hooded type mailboxes but, optionally, can also be installed on rearwardly flanged mailbox doors to provide a weatherproof installation.

DRAWING FIGURES

DETAILED DESCRIPTION OF FIRST CONFIGURATION

Figure 1:
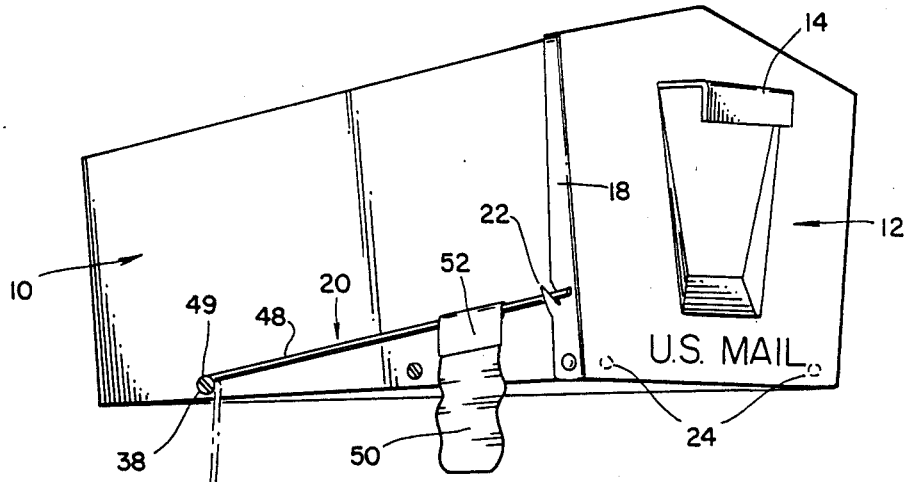
FIG. 1 shows a front and side perspective view of a mailbox with a first configuration mailbox device in the cocked position and, by dashed lines, also in the triggered position after release by opening the mailbox door.
Figure 2:
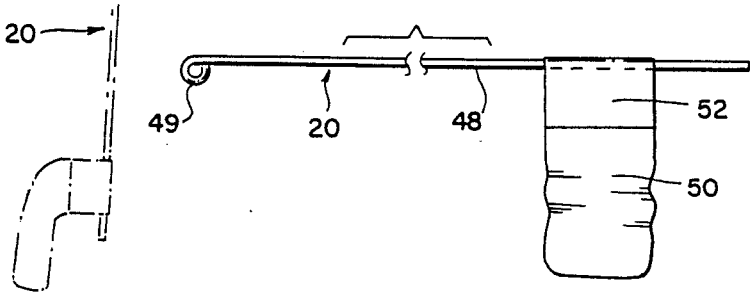
FIG. 2 shows a side view of the first configuration mailbox signal device assembly.
Figure 3:
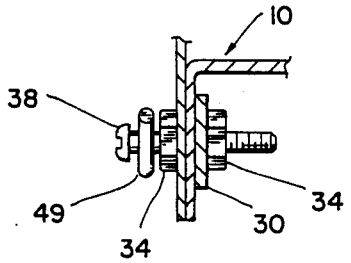
FIG. 3 shows a sectional view of how the mailbox signal device is attached through its eye at the rear end of the mailbox.

FIG. 1 is a perspective side and front view of a standard backwardly flanged mailbox 10 with door 12 and door handle 14. Shown installed is first configuration signal device assembly 20 in the cocked position and also in the triggered position. First configuration signal device assembly 20 consists of first configuration rod 48, eye 49, flexible flag 50, and adhesively backed flag fastener 52. Assembly 20 is described in more detail by referring to FIG. 2. First configuration rod 48 is a steel rod approximately 3/32 inches in diameter and length to suit a particular mailbox. Eye 49 is formed on the rear end of rod 48 and the rod's front end is straight. Flag 50, made of any selected color flexible plastic or cloth material, approximately 2 inches wide and 6 inches long, is attached near the front end of rod 48 using adhesively backed flag fastener 52. Fastener 52 is made of flexible material, is approximately 2 inches square, and is backed with a weather resistant adhesive. Front end installation of first configuration mailbox signal device assembly 20, as shown in FIG. 2, is accomplished by first making a short downwardly slanted cut, approximately one and one-half inches from the bottom edge of door 12, in the rearwardly extended door flange 18. The cut is then bent slightly outward, away from door flange 18, to make holding tab 22. The front end of the first configuration signal device assembly 20 will rest on holding tab 22 when in the cocked position. The front end of assembly 20 is cut to a length that does not extend past the front face of door 12. The front tip of assembly 20 is bent slightly outward to insure smooth operation when tripped. The rear end installation of the first configuration signal device assembly 20 is accomplished by utilizing existing mailbox mounting bolt 38. Bolt 38 passes through eye 49 and is secured near the back end of mailbox 10. FIG. 3 shows a typical installation detail through an existing rear mounting hole on mailbox 10. First, rear mounting bolt 38 is removed from mailbox 10. Then eye 49 is slipped onto mounting bolt 38. A mounting nut 34 is then screwed onto mounting bolt 38 leaving enough clearance for eye 49 to move freely. The free end of mounting bolt 38 is then passed through existing holes in mailbox 10 and mailbox post support frame 30 and secured with a second mounting nut 34.

Referring back to FIG. 1, with first configuration signal device assembly 20 secured to mailbox 10 through eye 49 and the front end cut to proper length, cocking is a simple procedure. First close mailbox door 12 then lift the front end of first configuration signal deice assembly to rest on holding tab 22. As door 12 is opened by the mail carrier to deliver mail the front tip of assembly 20 slips off of holding tab 22. Assembly 20, thus triggered, falls by gravity to a vertical position to indicate mail delivery has been made.

Cocking hole 24 is shown in FIG. 1 to illustrate an optional and weatherproof second configuration installation.

DETAILED DESCRIPTION OF SECOND CONFIGURATION

Figure 4:
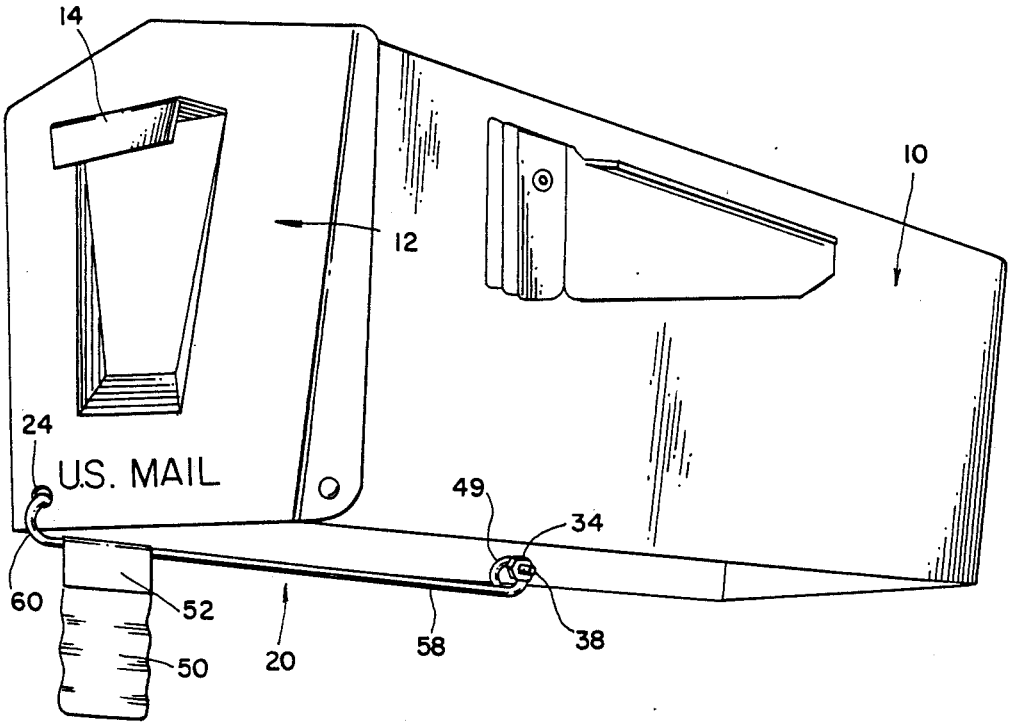
FIG. 4 shows a front and side perspective view of a mailbox with the second configuration mailbox signal device in the cocked position.
Figure 5:
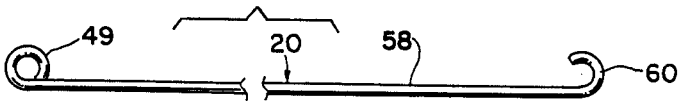
FIG. 5 shows a partial side view of the second configuration signal device assembly.
Figure 6:
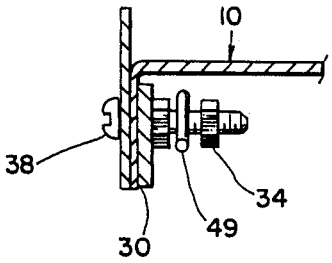
FIG. 6 shows a blown up view of how the second configuration signal device is attached through its eye at the rear end of the mailbox.

FIG. 4 is a front and side perspective view for a hooded type mailbox installation although it shown on a backwardly flanged mailbox. Cocking hole 24 is made in one lower corner of mailbox door 12, depending on which side of mailbox 10 the second configuration signal device assembly 20 is to be installed. Cocking hole 24 is made large enough for hook 60 to easily slip into it and rest on hole 24's lower edge when in the cocked position. Second configuration signal device assembly 20 differs from the first configuration only by hook 60 being formed on the front end of rod 58 instead of a straight front end rod 48. FIG. 5 shows a side view of second configuration signal device assembly 20 with hook 60 formed on the front end of rod 58, flag 50 and adhesive 52 are not shown. In all other aspects the two configurations of signal device 20 are identical. FIG. 6 shows a typical installation detail for second configuration signal device assembly 20 near the rear end of mailbox 10. A protruding end of mailbox mounting bolt 38 is utilized. This assumes mailbox 10 is already mounted on mailbox support frame 30. Eye 49 is slipped onto the protruding end of mailbox mounting bolt 38. A mailbox mounting nut 34 is threaded onto mailbox bolt 38 to secure eye 49 in place, but, leaving it free to move. With eye 49 of second configuration mailbox signal device assembly 20 secured, cocking is accomplished by guiding hook 60 into cocking hole 24 as mailbox door 12 is closed. As door 12 is opened hook 60 slips out of cocking hole 24 and the second configuration signal device 20 swings downward by gravity into the triggered position to indicate mail delivery. The foregoing is considered as illustrative only of the principles of the invention. The illustrated installation is depicted for a steel mounting post and top frame. Many rural mailboxes are mounted on wooden posts with wooden top pieces. In these cases the mailbox mounting bolt 38 will have substituted for it a wood screw of appropriate size. Other installations may require the substitution of a screw eye near the rear end of the mailbox. Also, some hooded type mailboxes have a forwardly protruding lip along the lower edge of the mailbox door. For this configuration hook 60 can rest on the lower protruding edge eliminating the need for cocking hole 24. Further, since other modifications and changes may occur to those skilled in the art, it is not desired to limit the invention to the exact construction and operation shown and described. Accordingly, all suitable modifications and equivalents that may be resorted to are claimed to fall within the scope of the invention. The scope of the invention is covered in the following claims.

I claim:

1. An automatic signaling device for attachment to a standard rural delivery mailbox having a sidewall, said mailbox having a door at the front end, said door having a flange bent rearward a short distance over said sidewall and a bent out tab formed on said rearwardly bent flange, said door being mounted for pivotable movement about the bottom edge of said front end from open to closed positions with respect to said front end, comprising:

(a) a rod member; and (b) fastening means connecting said rod member near the rear end of said sidewall for allowing said rod member to pivot by gravity from a position extending forwardly and upwardly adjacent said side wall to a position extending downwardly below the lower boundary of said sidewall;

(c) said rod member having a length sufficient to engage said bent out tab formed on said rearwardly bent flange at a position between said forwardly and upwardly extending position and said downwardly extending position and said rod member front end being a straight configuration;

(d) whereby when said door is closed and said rod member then moves downward from said forwardly and upwardly extending position, said straight front end of said rod member comes to rest on said bent out tab on said door flange in a substantially forwardly extending position, said rod member being released to fall into said downwardly extending position when said door is opened.

2. An automatic signaling device for attachment to a standard rural delivery mailbox having a sidewall and arched top, said mailbox having a door at the front end and including a hole in a lower corner thereof, said door being weather protected by forward protrusions of said sidewall and said arched top and being mounted for pivotable movement about the bottom edge of said front end from open to closed positions with respect to said front end, comprising:

(a) a rod member; and (b) fastening means connecting said rod member near the rear end of said sidewall for allowing said rod member to pivot by gravity from a position exerting forwardly and adjacent said side wall lower boundary to a position extending downwardly below the lower boundary of said sidewall;

(c) said rod member having a length sufficient to engage said hole in a lower corner of said door at said position extending forwardly and adjacent said side wall lower boundary and said rod member end being configured into an upwardly curved hook;

(d) whereby as said door is closed said upwardly curved hook is guided into said hole in a lower corner of said door holding said rod member in a substantially forwardly extending position, said rod member being released to fall into said downwardly extending position when said door is opened.

3. A flag as in either claim 1 or claim 2, further comprising a flag made of cloth or other flexible material and a fastener made of weather resistant adhesive tape, whereby said flag is attached near the front end of said rod member, and whereby said flag provides enhanced visibility when viewed from any direction from said mailbox with said rod member in a generally downward position.

* * * * *